US005285833A

United States Patent [19]

Haxby

[11] Patent Number: 5,285,833

[45] Date of Patent: Feb. 15, 1994

[54] THEFT RESISTANT PURSE

[76] Inventor: Susan I. Haxby, 327 E. Pearson, Apt. 1, Anaheim, Calif. 92802

[21] Appl. No.: 47,568

[22] Filed: Mar. 29, 1993

[51] Int. Cl.[5] ..... A45C 13/18

[52] U.S. Cl. ..... 150/102; 150/107; 150/134; 224/229; 224/240; 224/253

[58] Field of Search ..... 150/102, 107, 112, 117, 150/134, 135, 145; 224/240, 224, 226, 227, 229, 253

[56] References Cited

U.S. PATENT DOCUMENTS

| | | | |
|---|---|---|---|
| 1,529,958 | 3/1925 | Marcuo | 150/107 X |
| 3,578,225 | 5/1971 | Schroeder . | |
| 4,075,702 | 2/1978 | Davies | 150/135 X |
| 4,490,858 | 1/1985 | Batavier . | |
| 4,545,414 | 10/1985 | Baum | 150/107 X |
| 4,570,688 | 2/1986 | Williams | 150/102 X |
| 4,810,102 | 3/1989 | Norton | 224/151 X |
| 4,815,510 | 3/1989 | Edelist | 150/134 |
| 4,881,672 | 11/1989 | Gustafson . | |
| 4,998,653 | 3/1991 | LaBelle | 224/229 X |
| 5,075,900 | 12/1991 | Chittenden . | |

FOREIGN PATENT DOCUMENTS

| | | | |
|---|---|---|---|
| 2605503 | 4/1988 | France | 150/107 |

*Primary Examiner*—Allan N. Shoap
*Assistant Examiner*—Christopher McDonald
*Attorney, Agent, or Firm*—Robert A. Shack

[57] ABSTRACT

A purse designed to be worn by an individual, the purse being specifically designed to reduce the possibility of the purse being snatched away from the individual, the purse including a panel of material having a fold along which the panel of material is folded to create an interior surface of the panel of material and an exterior surface of the panel of material, the interior surface of the panel of material being substantially concealed when the panel of material is in a folded state. At least one interior pocket is formed on the interior surface of the panel of material, and a securement device is provided for securing the panel of material to the individual, the securement device being located on the panel of material substantially adjacent the fold.

9 Claims, 5 Drawing Sheets

THEFT RESISTANT PURSE

BACKGROUND

1. Field of the Invention

The present invention relates to a purse which is designed specifically to reduce the possibility that the purse will be snatched away from the owner.

Particularly in urban areas, purse snatching has become a major concern. An individual may be attacked at almost any time, and for nearly any reason, and traveling with a purse in plain view can be an open invitation to muggers. Additionally, while most purses are too bulky to be effectively concealed, particularly while walking, leaving one's purse at home is unfortunately usually not a viable option.

2. Description of the Related Art

U.S. Pat. No. 5,075,900 relates to a combination garment and purse, in which an article of clothing resembling a vest is provided with both inside and outside pockets. The vest-like garment includes a resilient yoke portion that extends across the back of the individual and acts to spread the weight of the articles carried.

U.S. Pat. No. 3,578,225 discloses a purse that is equipped with a number of fasteners along its upper edge, thus allowing it to be either hand carried or, optionally, attached to a shoulder strap.

U.S. Pat. No. 4,490,858 concerns a pocket for a garment that is designed to prevent pick-pocketing and which is provided with an attachment to the pocket opening that issues an alarm whenever the interior of the pocket is accessed.

U.S. Pat. No. 4,882,815 relates to a purse that is removably attached to the inside of a garment. Magnets are employed to sound an alarm whenever the purse is detached from the garment.

Finally, U.S. Pat. No. 4,881,672 discloses a device positioned on the shoulder of a garment by which the strap of a purse may be secured thereto. A removal actuated alarm may be included within the housing of the device.

SUMMARY OF THE INVENTION

In one aspect, the invention generally features a purse designed to be worn by an individual, the purse being specifically designed to reduce the possibility of the purse being snatched away from the individual, the purse including: a panel of material, the panel of material having a fold along which the panel of material is to be folded to create an interior surface of the panel of material and an exterior surface of the panel of material, the interior surface of the panel of material being substantially concealed when the panel of material is in a folded state; at least one interior pocket formed on the interior surface of the panel of material; and securement apparatus for securing the panel of material to the individual, the securement apparatus being located on the panel of material substantially adjacent the fold.

Preferably, the purse has opposing lateral sides, and the securement apparatus includes a first pair of rings, one each of the first pair of rings being attached to the panel of material adjacent the fold and adjacent one each of the opposing lateral sides, a second pair of rings, the second pair of rings being attached to the exterior surface of the panel of material adjacent the fold and spaced from one another along the axis of the folds, and a strap apparatus for attaching selectively to either the first pair of rings or the second pair of rings; the strap apparatus includes an adjustable length strap, a pair of clips, one each of the clips being secured to an end of the strap, a length adjustment apparatus for adjusting the length of the strap, and a buckle disposed intermediate the ends of the strap; the interior pocket includes a substantially transparent section when viewed from the interior surface of the panel of material, and the purse additionally includes a loop disposed on the interior surface of the panel of material, the loop being dimensioned to partially encircle and retain a writing instrument.

In another aspect, the invention generally features a purse designed to be worn by an individual, the purse being specifically designed to reduce the possibility of the purse being snatched away from the individual, the purse including: a panel of material, the panel of material having a length and a width, a fold located at substantially the middle of the length, an interior surface that is substantially concealed when the panel of material is folded at the fold, and an exterior surface opposite the interior surface; a plurality of interior pockets formed on the interior surface of the panel of material, each of the interior pockets being substantially concealed when the panel of material is folded at the fold; a closure device for closing at least one of the plurality of interior pockets; and an attachment apparatus for attaching the purse to the individual, the attachment apparatus including at least one pair of rings secured to the panel of material adjacent the fold.

Preferably, the panel of material is of generally oblong shape and has opposing lateral sides, and one each of the pair of rings is attached to one each of the opposing lateral sides of the panel of material; alternatively, each of the pair of rings is secured to the exterior surface of the panel of material immediately along the fold, the pair of rings being spaced from one another along the axis of the fold; the purse additionally includes a strip of reinforcement material attached to the exterior surface of the panel of material and extending substantially between the opposing lateral sides of the panel of material, one each of the rings being attached to one end of the strip of reinforcement material; the attachment apparatus additionally includes a second pair of rings, each of the second pair of rings being secured to the exterior surface of the panel of material immediately along the fold, and the second pair of rings being spaced from one another along the axis of the fold; the strip of reinforcement material extends substantially parallel to the fold and is spaced therefrom, and the attachment apparatus further includes a pair of reinforcement tabs secured to the exterior surface and extending from the strip of reinforcement material to the fold, the reinforcement tabs being spaced from one another along the axis of the fold and one each of the second pair of rings being secured to an end of one each of the reinforcement tabs; the purse additionally includes a strap apparatus for attaching selectively to either the first pair of rings or the second pair of rings, and for thereby providing selectively either a shoulder strap adapted to be worn over the shoulder of the individual or a waist strap adapted to be worn around the waist of the individual; the strap apparatus includes: an adjustable length strap; a pair of clips, one each of the clips being secured to an end of the strap, a length adjustment apparatus for adjusting the length of the strap, and a buckle disposed intermediate the ends of the strap; the fold separates the interior surface into two interior surface portions, the fold also separating the exterior surface into two exterior surface portions, and the purse additionally includes: a plurality of credit card pockets dimensioned to accept substantially standard sized credit cards, and at least one checkbook pocket dimensioned to accept a substantially standard sized checkbook, the credit card pockets and the checkbook pocket being located on a first of the interior surface portions, a substantially transparent pocket located on a second of the interior surface portions, the substantially transparent pocket having a substantially transparent visual surface when viewed from the second interior surface portion, an exterior pocket located on at least one of the exterior surface portions, and a closure apparatus for closing the exterior pocket; the purse additionally including a loop disposed on the interior surface of the panel of material, the loop being dimensioned to partially encircle and retain a writing instrument.

In yet another aspect, the invention generally features a purse designed to be worn by an individual, the purse being specifically designed to reduce the possibility of the purse being snatched away from the individual, the purse including: a generally oblong shaped panel of material having a length and a width; a fold provided at approximately the midpoint of the length of the panel, the panel being doubled over at the fold to produce an interior surface and an exterior surface; the fold separating the interior surface into two interior surface portions; the fold also separating the exterior surface into two exterior surface portions; a first of the interior surface portions including: a plurality of pockets dimensioned to accept substantially standard sized credit cards; and at least one pocket dimensioned to accept a substantially standard sized checkbook; a second of the interior surface portions including: a substantially transparent pocket having a substantially transparent visual surface when viewed from the second interior surface portion; and at least one of the exterior surface portions including an exterior pocket; and a closure apparatus for closing the exterior pocket.

Preferably, the purse additionally includes a loop disposed on the first interior surface portion of the panel of material, the loop being dimensioned to partially encircle and retain a writing instrument, and a zipper for closing the substantially transparent pocket.

One object of the invention is the provision of a purse that will deter a purse snatcher because it can be securely attached to the individual using it.

Another object of the invention is the provision of a purse that will reduce the possibility of it being snatched because it is small in size, unobtrusive and can be worn in an inconspicuous manner.

A still further object of the invention is the provision of such a purse which nonetheless allows the individual using it to carry an adequate number of items therein.

The invention will now be described by way of a particularly preferred embodiment, reference being made to the accompanying drawings, wherein:

DESCRIPTION OF THE PREFERRED EMBODIMENT

Figure 5:
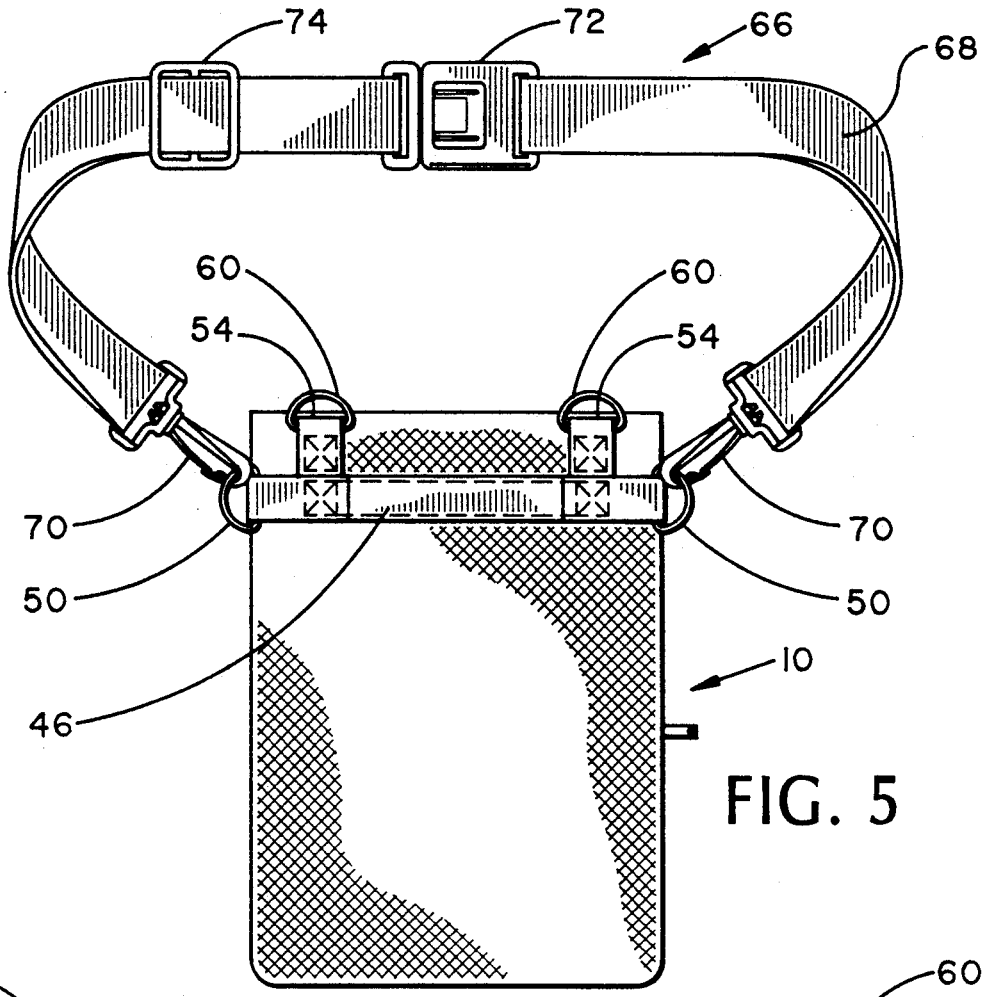
FIG. 5 is a rear elevational view of the purse in the folded state, with particular attention being paid to showing one manner of attachment of a strap to the purse, according to the invention.
Figure 3:
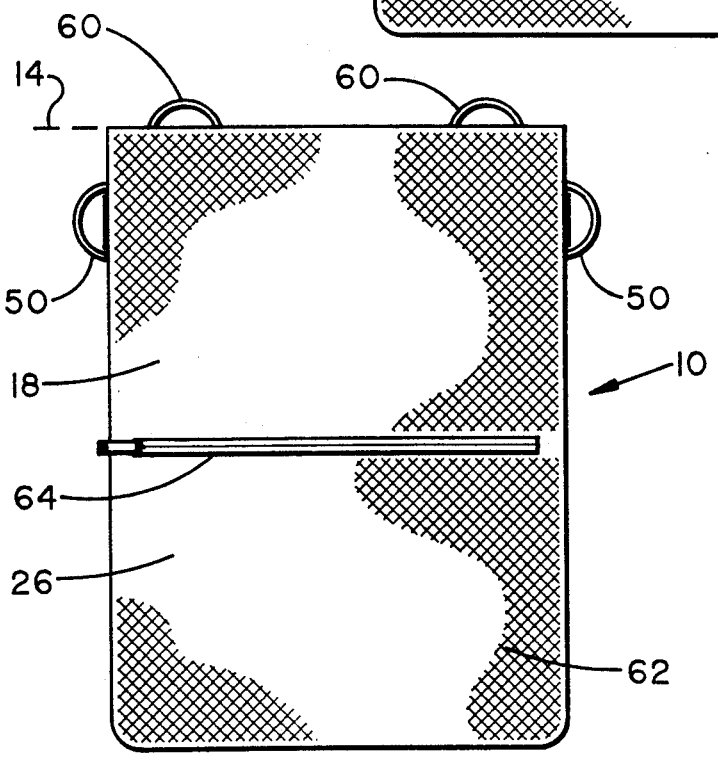
FIG. 3 is a front elevational view of the purse, with the purse being shown here in a closed (or "folded") condition.
Figure 4:
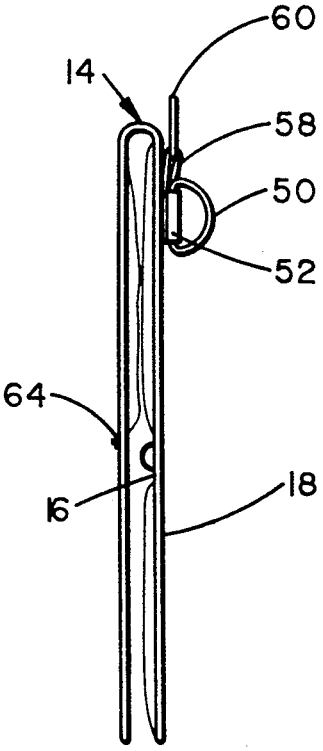
FIG. 4 is a side elevational view of the purse in its folded state.

Referring to all of FIGS. 1–7, but now most particularly to FIGS. 1–4, a purse 10 constructed according to the invention generally includes a panel of material 12, upon which various components as hereinafter described are provided. The panel of material 12 is preferably of a flexible material and is, in any case, provided with a fold 14 along which the panel 12 can be folded. When folded, as shown in FIGS. 3–5, the panel 12 defines an interior surface 16 (shown most clearly in FIG. 1) and an exterior surface 18 (shown most clearly in FIG. 2). The fold 14 also effectively divides the interior surface 16 into first and second interior portions 20 and 22, respectively, and the exterior surface 18 into first and second exterior portions 24 and 26, respectively.

The interior surface 16 of the panel 10 has constructed on and/or attached thereto a number of pockets for holding various articles that might otherwise be carried in a bulkier, more conventional purse. Thus, preferably, the first interior portion 20 of the interior surface 16 of the panel 10 is provided with a number of credit card pockets 28, each of which is dimensioned to accept a standard sized credit card (a number of such credit cards being indicated by reference numeral 29), another pocket 30 dimensioned to accept a checkbook, and a still further pocket 32 dimensioned to accept foldable cash currency.

Additionally, the second interior portion 22 of the interior surface 16 of the panel 10 is also preferably provided with a cosmetic pocket 34. The cosmetic pocket 34 preferably has a transparent window 36, which allows the individual to view its contents, and is provided with a zipper 38 for its closure. For purposes of illustration, a lipstick 40 is shown within the cosmetic pocket 34, the lipstick 40 being viewable through the transparent window 36 from the direction of the interior surface 16.

The first interior portion 20 of the interior surface 16 also has a loop 42, which is of such a size as to accept and retain a pen or pencil 44.

Figure 2:
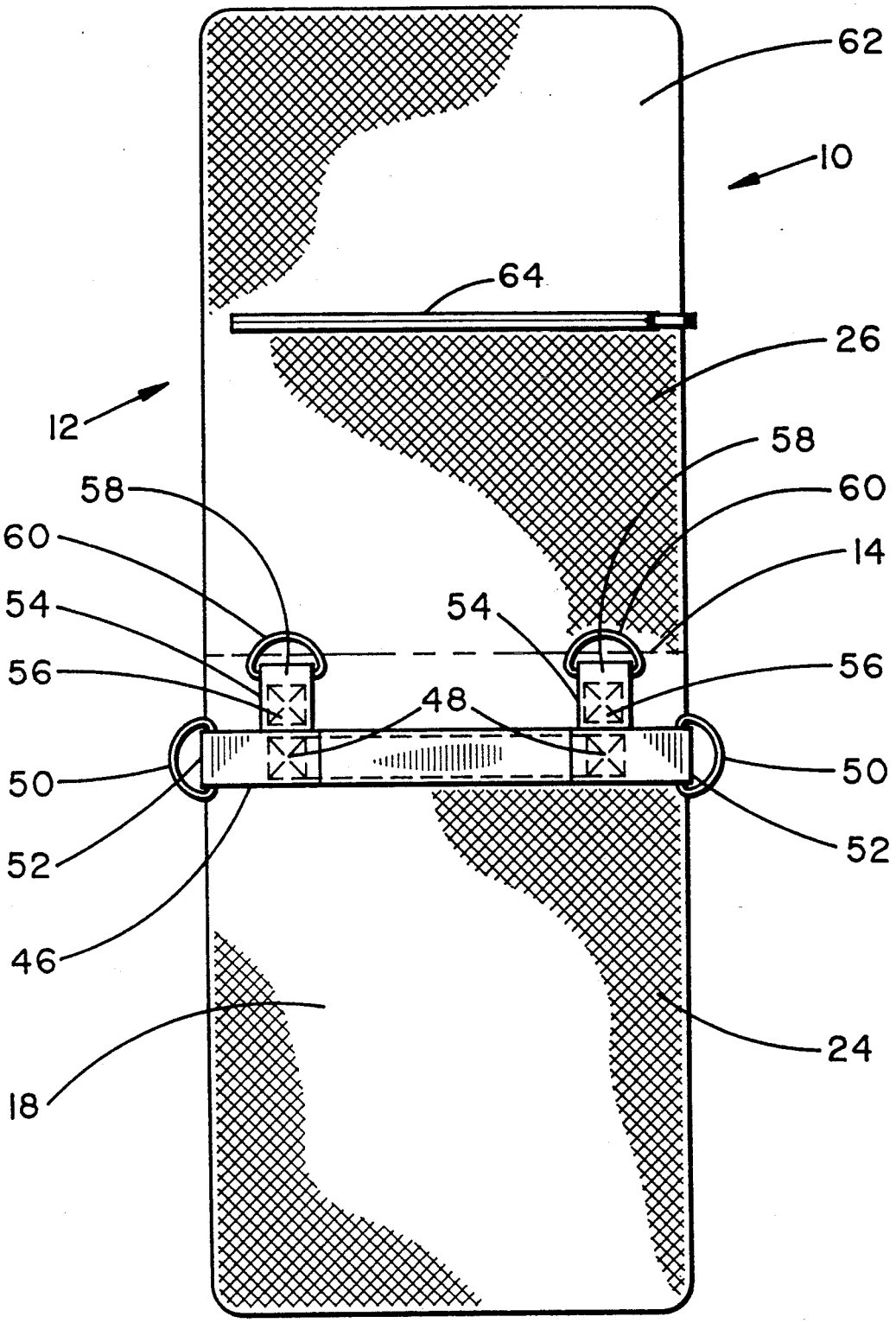
FIG. 2 is a rear elevational view of the purse in the open state.

Referring now most particularly to FIG. 2, the first exterior portion 24 of the exterior surface 18 has attached thereto a reinforcement strip 46 which extends between the lateral sides of the panel of material 12, and which is attached to the first exterior portion 24 of the exterior surface 18, for example, by stitchings 48. A first pair of D-rings 50 pass through loops 52 formed at the ends of the reinforcement strip 46. A pair of reinforcement tabs 54 extend upward from the reinforcement strip 46 to adjacent the fold 14. The reinforcement tabs 54 are attached to the exterior surface 18 by stitchings 56 and are provided at their ends with loops 58 through which pass a second pair of D-rings 60. As shown, the second pair of D-rings 60 are preferably attached to the exterior surface 18 immediately along the fold 14.

The second exterior portion 26 of the exterior surface 18 is provided with an exterior pocket 62, which is closed by means of a zipper 64.

Referring now to FIG. 5, the purse 10 can preferably be used in conjunction with an adjustable waist/shoulder strap device 66, which generally includes a strap 68, a pair of springed closure type snap-on clips 70, attached to the opposite ends of the strap 66, a buckle 72 located intermediate the ends of the strap 66, and a length adjustment device 74. Through use of the length adjustment device 74, the length of the strap 68 can be adjusted to either fit snugly about the waist of the individual, or adjusted to a length where it can be slung over the shoulder of the individual. When worn snugly about the waist, the clips 70 are preferably clipped to the first pair of D-rings 50, as shown in FIG. 5, while, in the case where the purse 10 is to be slung over the shoulder, the clips 70 are preferably clipped to the second pair of D-rings 60.

Additionally, it is quite possible for the purse 10 to be used without the waist/shoulder strap device 66, since the purse 10 may be easily folded over a belt or other similar piece of already existing apparel. For example, a particularly advantageous manner of using the purse 10 of the present invention, without the waist/shoulder strap device 66, is to simply fold the purse 10, at the fold 14, over the owner's belt or waistband. When utilized in this manner, the purse 10 may be worn, for example, with half of the purse 10 tucked inside of the owner's garment (e.g., pants or skirt) and half outside.

Figure 6:
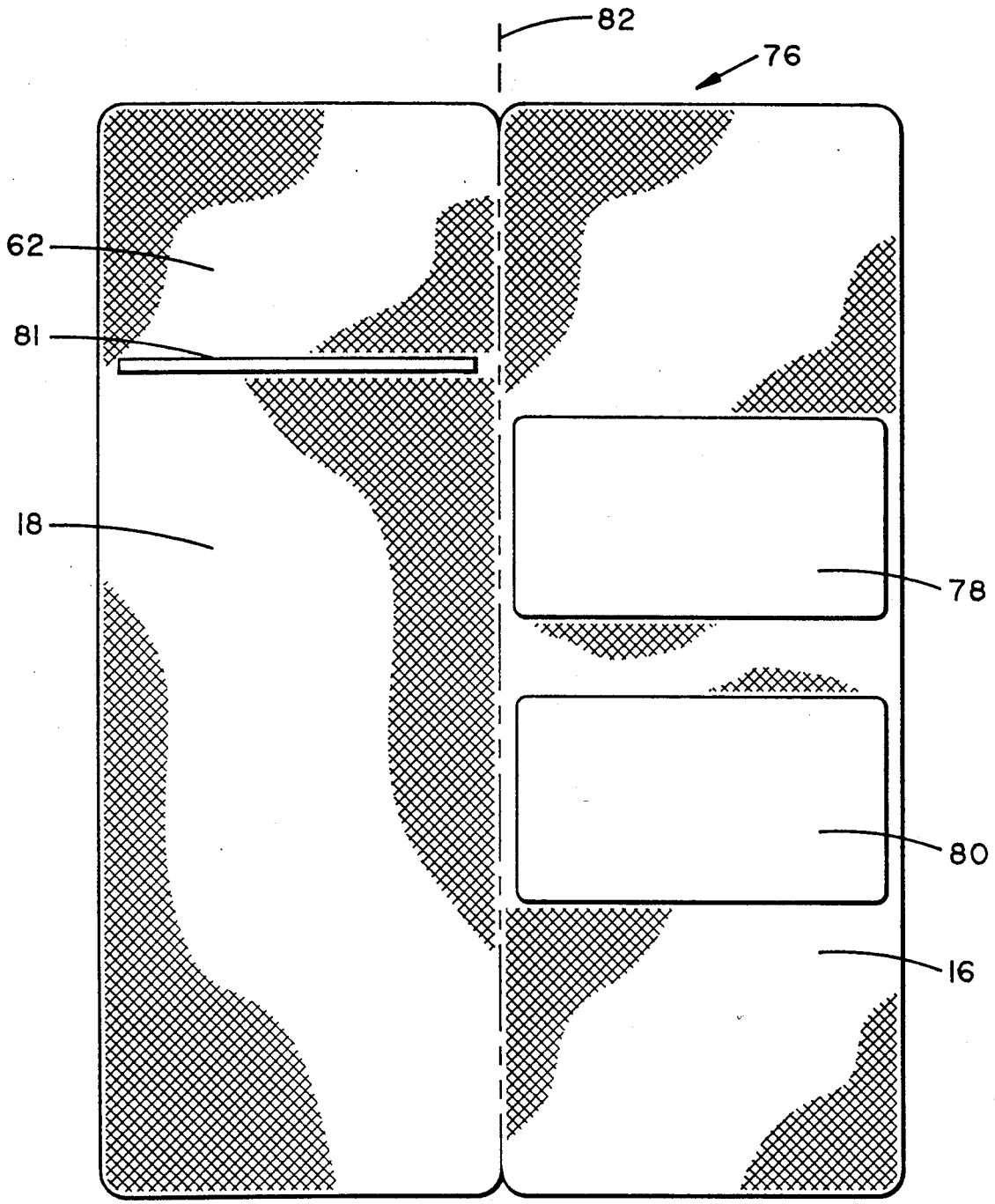
FIG. 6 is a front elevational view of a blank of material from which the purse may be constructed.
Figure 7:
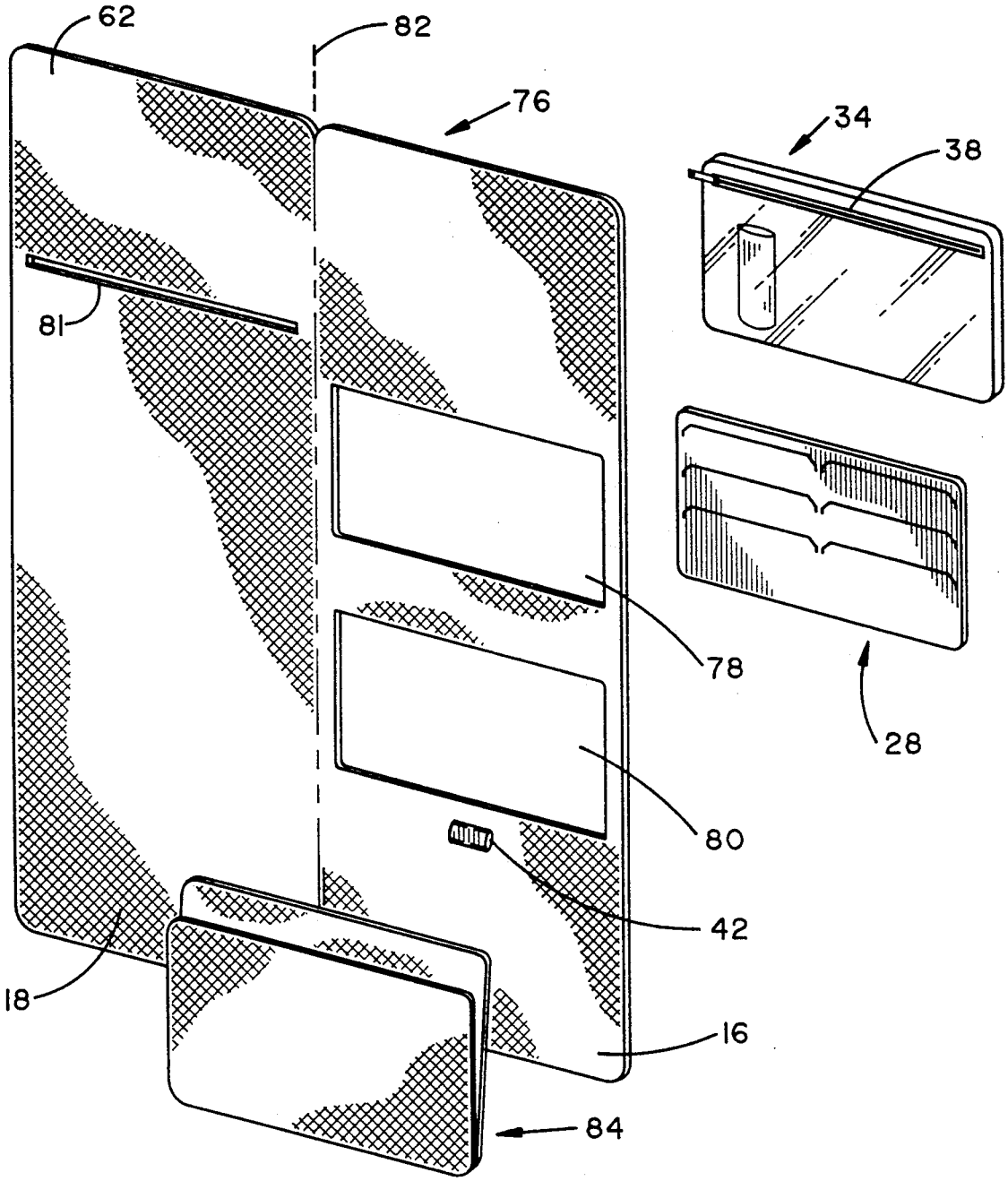
FIG. 7 is a perspective view of the blank of FIG. 6, also showing additional components of the purse that are preferably attached thereto.

A preferred manner of construction of the purse 10 is illustrated in FIGS. 6 and 7. In FIG. 6, there is shown a die-cut piece of material 76 from which the panel of material 12 may be preferably constructed. One side of the piece of material 76, which may be woven nylon or vinyl or any similar flexible fabric, is provided with a cutout 78 for the cosmetic pocket 34 and a cutout 80 for a credit card holder insert (both of which are described more fully below). The other side of the piece of material 76 is provided with a cutout 81 into which the zipper 64 described above may be fitted. The piece of material 76 is then folded along a generally vertical fold line 82 to thereby produce the panel of material 12.

Figure 1:
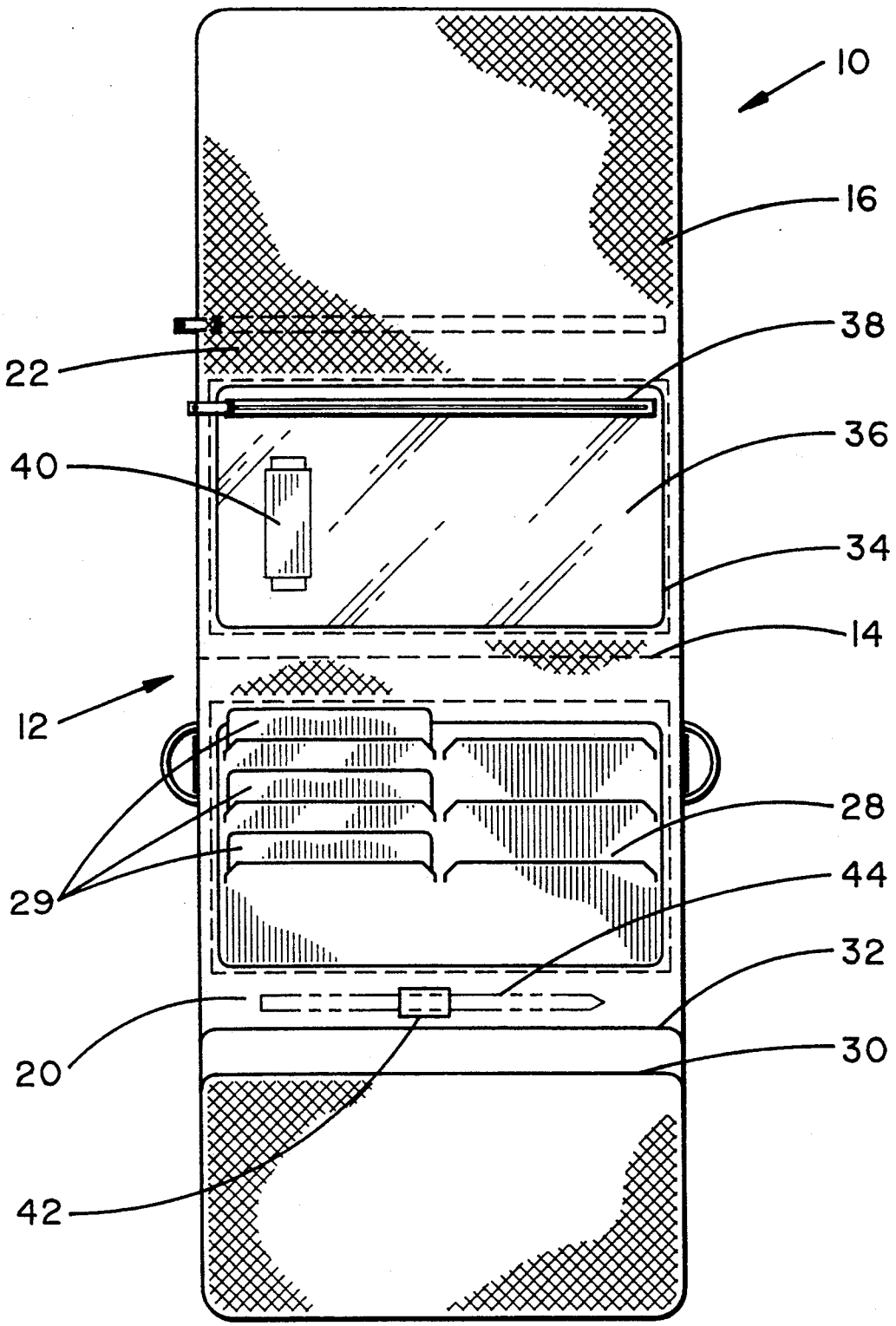
FIG. 1 is a front elevational view of a purse constructed according to the invention, with the purse being shown in an open (or "unfolded") state.

Referring to FIGS. 1 and 7, preferably the cutouts 78 and 80 for the cosmetic pocket 34 and the credit card holder 28, respectively, are "undersized" with respect to these components such that they can be positioned and thus secured between the interior and exterior surfaces 16 and 18, respectively, of the panel of material 12. The exterior pocket 62 may preferably be formed between the interior and exterior surfaces 16 and 18, respectively, by the act of folding the piece of material 76 along the fold 82. Finally, the checkbook pocket 30 and the paper currency pocket may preferably be formed by the attachment of a pair of flaps 84 (or, alternatively, a single piece of material folded to produce the pair of flaps 84) to the interior surface 16.

While the invention has been herein described by way of a particular preferred embodiment, various substitutions of equivalents may be effected without departing from the spirit and scope of the invention as set forth in the following claims.

What is claimed is:

1. A purse, designed to be worn by an individual, said purse being specifically designed to reduce the possibility of said purse being snatched away from the individual, wherein said purse has opposing lateral sides, said purse comprising:

a panel of material, said panel of material having a fold along which said panel of material is adapted to be folded to create an interior surface of said panel of material and an exterior surface of said panel of material, said interior surface of said panel of material being substantially concealed when said panel of material is in a folded state;

at least one interior pocket formed on said interior surface of said panel of material; and securement means for securing said panel of material to the individual, said securement means being located on said panel of material substantially adjacent said fold; wherein said securement means comprises:

a first pair of D-rings, one each of said first pair of D-rings being attached to said panel of material adjacent said fold and on one each of said opposing lateral sides;

a second pair of D-rings, said second pair of D-rings being attached to said exterior surface of said panel of material substantially on said fold and spaced from one another along the axis of said fold: and strap means for attaching selectively to either said first pair of D-rings or said second pair of D-rings.

2. A purse according to claim 1, wherein said strap means comprises:

an adjustable length strap;

a pair of clips, one each of said clips being secured to an end of said strap; length adjustment means for adjusting the length of said strap; and a buckle disposed intermediate the ends of said strap.

3. A purse according to claim 2, wherein said interior pocket comprises a substantially transparent section when viewed from said interior surface of said panel of material, and wherein said purse additionally comprises a loop disposed on said interior surface of said panel of material, said loop being dimensioned to partially encircle and retain a writing instrument.

4. A purse designed to be worn by an individual, said purse being specifically designed to reduce the possibility of said purse being snatched away from the individual, said purse comprising:

a panel of material, said panel of material having a length and a width, a fold located at substantially the middle of said length, an interior surface that is substantially concealed when said panel of material is folded at said fold, and an exterior surface opposite said interior surface;

a plurality of interior pockets formed on said interior surface of said panel of material, each of said interior pockets being substantially concealed when said panel of material is folded at said fold;

closure means for closing at least one of said plurality of interior pockets;

attachment means for attaching said purse to the individual, said attachment means comprising at least one pair of D-rings secured to said panel of material adjacent said fold;

wherein said panel of material is of generally oblong shape and has opposing lateral sides, and wherein one each of said pair of D-rings is attached to one each of said opposing lateral sides of said panel of material;

said purse additionally comprising a strip of reinforcement material attached to said exterior surface of said panel of material and extending substantially between said opposing lateral sides of said panel of material, one each of said D-rings being attached to one end of said strip of reinforcement material;

wherein said attachment means additionally comprises a second pair of D-rings, each of said second pair of D-rings being secured to said exterior surface of said panel of material immediately along said fold, and said second pair of D-rings being spaced from one another along the axis of said fold.

5. A purse according to claim 4, wherein said strip of reinforcement material extends substantially parallel to said fold and is spaced therefrom, and wherein said attachment means further comprises a pair of reinforcement tabs secured to said exterior surface and extending from said strip of reinforcement material to said fold, said reinforcement tabs being spaced from one another along the axis of said fold and one each of said second pair of D-rings being secured to an end of one each of said reinforcement tabs.

6. A purse according to claim 5, said purse additionally comprising strap means for attaching selectively to either said first pair of D-rings or said second pair of D-rings, and for thereby providing selectively either a shoulder strap adapted to be worn over the shoulder of the individual, or a waist strap adapted to be worn around the waist of the individual.

7. A purse according to claim 6, wherein said strap means comprises:

an adjustable length strap;

a pair of clips, one each of said clips being secured to an end of said strap; length adjustment means for adjusting the length of said strap; and a buckle disposed intermediate the ends of said strap.

8. A purse according to claim 7, wherein said fold separates said interior surface into two interior surface portions, wherein said fold also separates said exterior surface into two exterior surface portions, and wherein said purse additionally comprises:

a plurality of credit card pockets dimensioned to accept substantially standard sized credit cards; and at least one checkbook pocket dimensioned to accept a substantially standard sized checkbook;

said credit card pockets and said checkbook pocket being located on a first of said interior surface portions;

a substantially transparent pocket located on a second of said interior surface portions;

said substantially transparent pocket having a substantially transparent visual surface when viewed from said second interior surface portion;

an exterior pocket located on at least one of said exterior surface portions; and closure means for closing said exterior pocket.

9. A purse according to claim 8, said purse additionally comprising a loop disposed on said interior surface of said panel of material, said loop being dimensioned to partially encircle and retain a writing instrument.

* * * * *

UNITED STATES PATENT AND TRADEMARK OFFICE

CERTIFICATE OF CORRECTION

PATENT NO. : 5,285,833

DATED : February 15, 1994

INVENTOR(S) : Susan I. Haxby

It is certified that error appears in the above-indentified patent and that said Letters Patent is hereby corrected as shown below:

On the Title Page, Item [76], change "Susan" to --Suzan--.

Signed and Sealed this

Thirty-first Day of May, 1994

Bruce Lehman

*Attest:*

BRUCE LEHMAN

*Attesting Officer*

*Commissioner of Patents and Trademarks*